United States Patent [19]

Sentell

[11] 4,225,362

[45] Sep. 30, 1980

[54] METHOD FOR CLEANING THE INTERIOR OF TUBES

[75] Inventor: John S. Sentell, Baton Rouge, La.

[73] Assignee: Richard R. Paseman, Houston, Tex.

[21] Appl. No.: 4,616

[22] Filed: Jan. 18, 1979

Related U.S. Application Data

[62] Division of Ser. No. 831,767, Sep. 9, 1977, Pat. No. 4,137,928.

[51] Int. Cl.[2] ..... B08B 3/02; B08S 9/04

[52] U.S. Cl. ..... 134/24; 165/95

[58] Field of Search ..... 239/239, 240, 237; 118/DIG. 10, 317; 15/104.1 R; 134/22 C, 24, 167 R, 167 C, 168 C, 169 C, 172, 178, 179, 198; 165/95; 427/236

[56] References Cited

U.S. PATENT DOCUMENTS

| | | | |
|---|---|---|---|
| 1,982,590 | 11/1934 | Church et al. | 134/178 X |
| 2,245,575 | 6/1941 | Court | 134/179 X |
| 2,735,794 | 2/1956 | Pletcher | 134/24 |
| 3,246,847 | 4/1966 | Hammelmann | 239/239 X |
| 3,516,385 | 6/1970 | Walling | 118/317 X |
| 3,525,426 | 8/1970 | Miller | 134/22 C X |
| 3,601,136 | 8/1971 | Marcham | 134/167 R |
| 3,791,583 | 2/1974 | Nunlist et al. | 134/167 R |
| 3,797,745 | 3/1974 | Haus | 118/317 X |
| 3,901,252 | 8/1975 | Riebe | 134/167 C X |
| 4,085,474 | 4/1978 | Murphy | 134/167 C X |

*Primary Examiner*—Richard V. Fisher

*Attorney, Agent, or Firm*—Pravel, Gambrell, Hewitt, Kirk, Kimball & Dodge

[57] ABSTRACT

A spray head with nozzles is carried on a lance to spray high pressure fluid, such as water, to clean the interior of tubes, such as those in heat exchangers. The fluid, in addition to cleaning the interior of the tube, is used to both rotate the lance and move the lance into and out of the tube.

7 Claims, 5 Drawing Figures

10
12
14
16
18
20
22
24
26
28
29
30
32
34
36
38
40
42
44
44a
44b
45
46
48
50
52
54
60
66
A
C
F
H
L
S
T
V
3
4

METHOD FOR CLEANING THE INTERIOR OF TUBES

CROSS-REFERENCE TO RELATED APPLICATIONS

This is a divisional application of U.S. patent application Ser. No. 831,767 filed Sept. 9, 1977 copending herewith and now U.S. Pat. No. 4,137,928.

BACKGROUND OF THE INVENTION

1. Field of the Invention

The present invention relates to cleaning the interior of tubes.

2. Description of Prior Art

In U.S. Pat. Nos. 3,246,847 and 3,791,583 systems for reciprocating pressurized fluid spraying head cleaning systems are disclosed. These systems utilized pistons to control application of fluid pressure and thereby control advance and retraction of the spraying head. However, in U.S. Pat. No. 3,246,287, the valve which controlled the direction of movement was located at a position in contact with the fluid, which could have particles and debris therein, and the valve could thus become clogged and inoperative. The structure in U.S. Pat. No. 3,791,583 was designed for spray cleaning relatively large vessels such as chemical reactors, storage tanks and the like, and thus was, so far as is known, not readily suitable for cleaning elongate tubular objects, such as pipes and tubes.

In U.S. Pat. No. 3,791,583, previously discussed, and in U.S. Pat. No. 3,601,136, pressurized fluid was used to drive a turbine which moved the remaining parts of the system.

Other types of fluid pressure tube cleaning systems are disclosed in U.S. Pat. Nos. 620,224; 2,494,380; 3,246,660; 3,269,659; 3,377,026; 3,589,388; 3,736,909; 3,794,051; 3,817,262; 3,901,252; 3,903,912; 3,938,535; and 3,987,963.

So far as is known, the typical systems currently used in cleaning heat exchanger tubes have used pneumatic motors to move the cleaning lances into and out of the tubes.

SUMMARY OF INVENTION

With the present invention, it has been found that a separate motor to move the cleaning lance through the tubes need not be used, but that the cleaning fluid itself can be utilized to both reciprocate and rotate the cleaning head, causing an increased cleaning action.

Briefly, the present invention provides a new and improved apparatus and method for cleaning the interior of elongate tubular objects, such as pipes, tubes and the like, with pressurized fluid. A spray head, having nozzles for directing the fluid against the interior of the elongate tubular object to be cleaned, is mounted with a lance which receives the fluid from a supply cylinder. The lance also transports the spray head through the object and supplies the fluid from the supply cylinder to the nozzle. A piston mounted with the lance causes reciprocating longitudinal movement of the lance through the object in response to the fluid. The piston is so formed that the pressurized fluid causes the piston, lance and spray head to rotate as the lance and cleaning head move, under force exerted by the fluid, through the object being cleaned. The rotational movement so achieved is obtained without requiring turbines and complex intermediate gearing of the type disclosed in the prior art.

DESCRIPTION OF THE PREFERRED EMBODIMENT

Figures 1, 2:
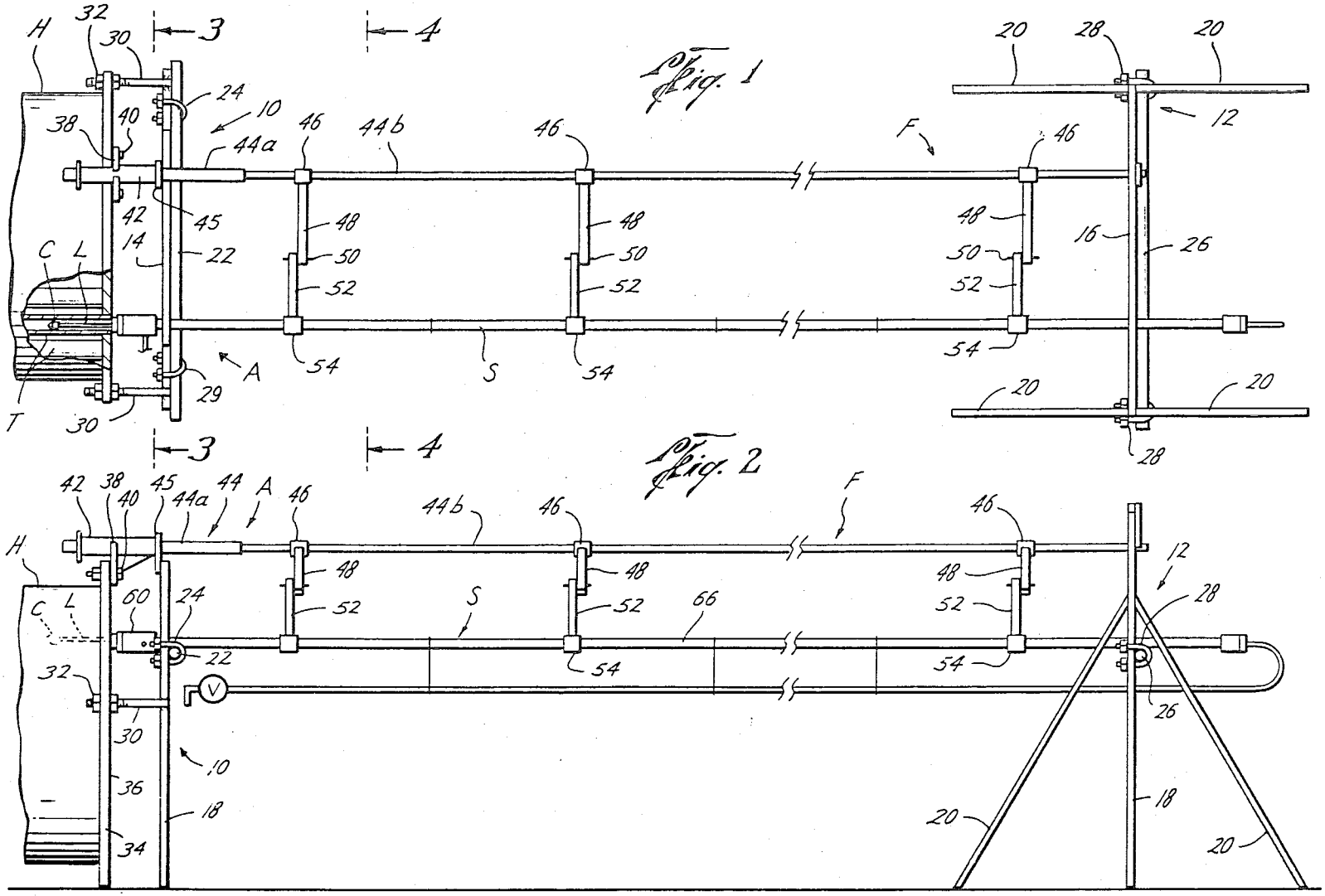
FIG. 1 is a plan view, taken partly in cross-section, of an apparatus according to the present invention.
FIG. 2 is an elevation view of an apparatus according to the present invention.
Figure 4:
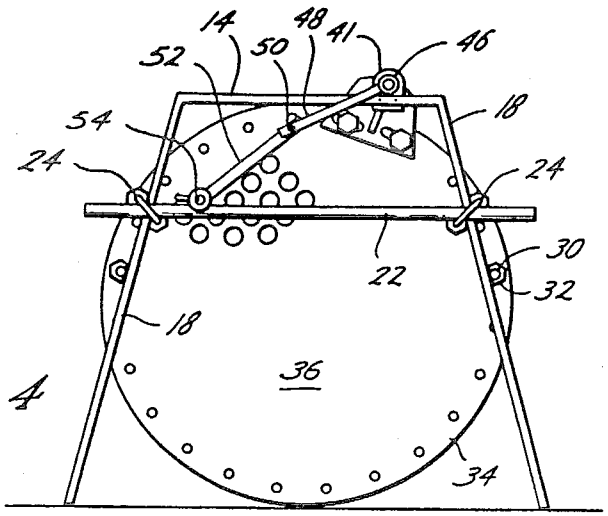
FIG. 4 is a view taken along the lines 4—4 of FIG. 1.

In the drawings, the letter A designates generally the apparatus of the present invention for cleaning elongate tubular objects, such as a group of tubes T in a heat exchanger bundle H, using pressurized fluid, typically water. As will be set forth in detail below, the apparatus A includes a cleaning spray head C (FIG. 5) mounted with a lance L which transports the spray head C through the tube T during cleaning operations. The lance L is supplied with the pressurized fluid from a supply cylinder S which supplies the fluid to the lance L and the spray head C. The supply cylinder S is mounted adjacent the heat exchanger H with suitable support frame structure F.

The support frame F (FIGS. 1 and 2) includes a front support frame 10 and a rear support frame 12, each in the general configuration of an inverted U. The front support frame 10 and the rear support frame 12 may each be formed from tubes, beams and the like, and include transverse upper post members 14 and 16, respectively, mounted at the upper ends of support legs 18. The rear support frame 12 further includes struts 20 for supporting the legs 18.

The front support frame 10 further includes a cross bar member 22 which is movably mounted with each of the legs 18 by U-bolts 24 or other suitable attaching structure. Due to the movable mounting of bar member 22 with the legs 18, the cross bar 22 may be raised and lowered on the front support frame 10 to various positions supporting the supply cylinder S in order to align the lance L and cleaning head C with tubes T at various heights in the heat exchanger H during cleaning operations. In a like manner, a cross-bar member 26 is movably mounted with the legs 18 of the rear support frame 12 so that the supply cylinder S may be raised and lowered to various levels during cleaning operations.

Figure 3:
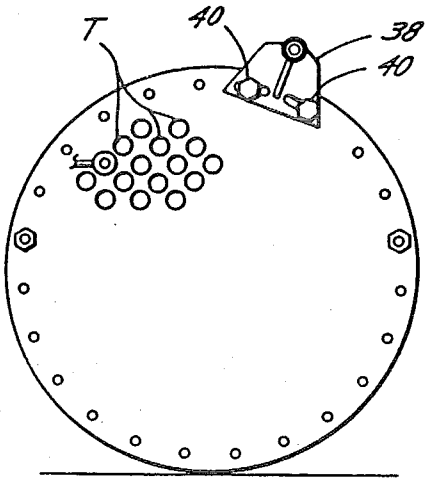
FIG. 3 is a view taken along the lines 3—3 of FIG. 1.

The front support frame 10 further includes forwardly extending connector members 30 for attaching the front support frame 10 to the heat exchanger H by being bolted, as indicated at 32, to a flange 34 adjacent a front face 36 of the heat exchanger H. The support frame 10 is also attached to the heat exchanger H by a faceplate 38 which is bolted, as indicated at 40, to the face 36 of the heat exchanger H at the flange 34 (FIGS. 1–3).

The faceplate 38 has mounted therewith a tubular collar member 42 which receives therein a support pipe 44. The collar member 42 is also mounted with the post member 14 by means of a plate 45. The support pipe 44 includes an enlarged diameter member **44*a* which is rotatably mounted in the collar 42 but is restrained against longitudinal movement with respect thereto by means of pins or other suitable structure. An elongate rear portion 44*b* of the support pipe 44 extends rearwardly from the portion 44***a* and is fixedly mounted with the rear support frame 12 so as not to be movable with respect thereto.

A plurality of collars 46 are mounted with the elongate rear portion 44*b* of the support pipe along the length thereof. Each of the collars 46 has mounted therewith a first pivot arm 48 which is pivotally connected by a pin 50 to a second pivot arm 52 having a collar 54 formed at an opposite end thereof. The collars 54 are mounted at spaced locations along the length of the supply cylinder S so that the supply cylinder S is suspended from the support structure F between the front and rear support frames 10 and 12. The supply cylinder S further rests on the cross-bar member 22 of the support frame 10 and on the cross-bar member 26 of the rear support frame 12.

Due to pivotal connection at the pin 50 between the pivot arms 48 and 52, the relative position of the support cylinder S may be adjusted transversely across the face 36 of the heat exchanger H so that the cleaning head C and lance L may be moved into alignment with each of the tubes T in a horizontal row. Further, as has been set forth above, the relative position of the cross bars 22 and 26 may be raised and lowered, as needed, to bring the cleaning head C and lance L into alignment with a higher or lower row of tubes T in the heat exchanger H during cleaning operations.

Considering now the supply cylinder S more in detail (FIG. 5), an inlet head 60 thereof is mounted at a position adjacent the front support frame 10 and receives pressurized cleaning fluid, such as water, at an inlet port 62 through a supply conduit 64. An elongate tube 66 of the supply cylinder S mounted with inlet head 60 extends rearwardly therefrom and is supported on the cross bar 26 of the rear support frame 12. An end cap 68 is mounted with the end of the tube 66 by means of a suitable coupling 70. The end cap 68 has a central passage 72 formed therein and has connected therewith a tubular member 74 for conveying the pressurized fluid out of the supply cylinder S. The tube 74 is preferably flexible, for reasons to be set forth, and has mounted at an end portion thereof a valve 75 for controlling the flow of the pressurized fluid in the supply cylinder S. The cleaning lance L is mounted with a portion 80 thereof in the supply cylinder S and with a portion 82 thereof extending outwardly through an opening 84 formed in the inlet head 60. A packing 86 and a metal ring 88 for holding a suitable lubricant are mounted adjacent the opening 84 in the inlet head 60 and are held in place therewith by means of an end cap 90 threadedly mounted with the inlet head 60.

A guide sleeve 92 extends forwardly from the end cap 90 to abut the face 36 of the heat exchanger H and enclose and protect the lance L against bending or damage. The lance L has the spray head C mounted at a front or inner end thereof and a piston P mounted at an opposite end thereof. The piston P has a passage 94 extending inwardly from a rear face 96 in order that fluid from the supply cylinder S may enter a passage 98 formed in the hollow lance L and convey fluid to the spray head C. The piston P further has a front surface 102 against which pressurized fluid in the supply cylinder S acts, as will be set forth below. A side surface portion 104 of the piston P between the surfaces 102 and 96 has spiral portions thereof removed in order to form a spiral grooved surface on the piston P for passage of pressurized fluid therethrough, for reasons to be set forth below.

The cleaning head C has a plurality of nozzles 106 formed thereon in order that pressurized fluid from the interior 98 of the lance L may pass therethrough and be directed against debris or sediment 108 accumulating in the interior of the tubes T to be cleaned.

Figure 5:
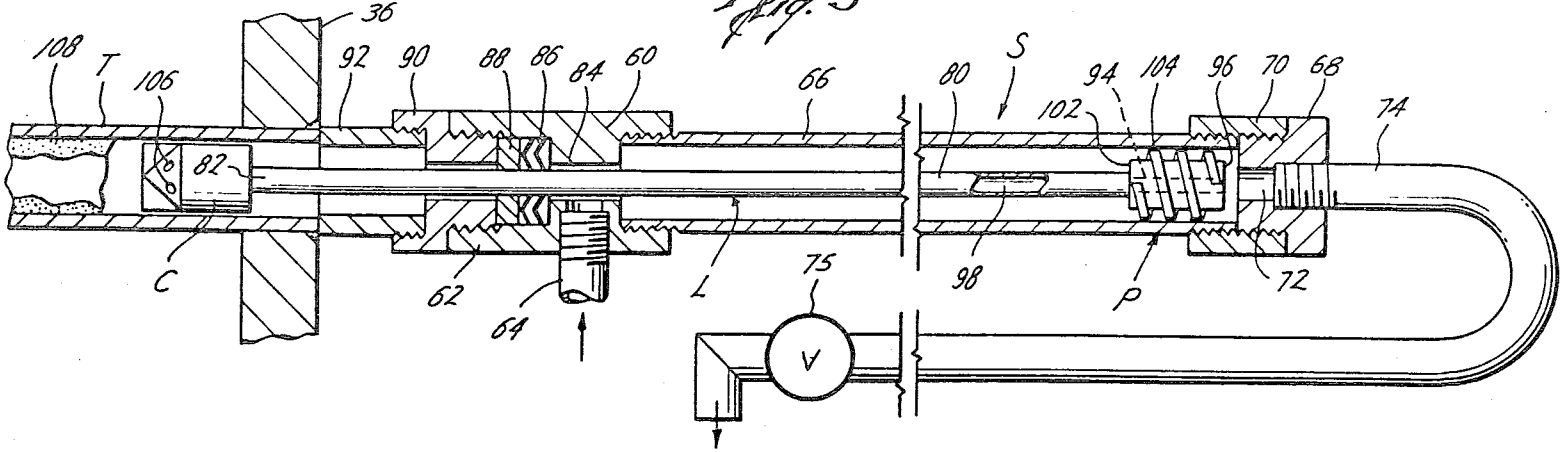
FIG. 5 is an enlarged cross-sectional view of portions of the apparatus of FIG. 1.

In the operation of the present invention, the cleaning head C, lance L and support cylinder S are brought into position on the support frame F mounted in alignment with the longitudinal axis of a particular tube T to be cleaned. The valve 75 is open to permit the passage of pressurized fluid outwardly from the tube 74. With the valve 75 open, pressurized fluid acts on the face 102 of the piston P moving the lance L and cleaning head C rearwardly to the retracted position (FIG. 5). Further, with the tube 74 being flexible, the valve 75 may be operated by an equipment operator standing adjacent the face 36 of the heat exchanger H and at selected operating positions thereafter, rather than being required to move to the end of the supply cylinder S to operate the valve 75. The cleaning head C and the portion 82 of the lance L are inserted into the tube T to be cleaned. The valve 75 is then closed, blocking the flow of pressurized fluid outwardly of the tube 74, causing the pressurized fluid to act on the surface 96 of the piston P and move the lance L and the spray head C inwardly into the tube T along the longitudinal axis thereof. Further, the pressurized fluid in the supply cylinder S has no exit other than the nozzles 106 in the spray head C and accordingly enters the passage 94 in the piston P and travels through the interior 98 of the lance L to the spray head C where it is directed by the nozzles 106 against the sediment 108.

The pressurized fluid passing from the spray head C reacts turbulently with the sediment 108, loosening such sediment and causing the loosened sediment to be transported by the fluid. The fluid discharged in the tube T from the spray head C transports the loosened sediment past the remaining deposited sediment out of the tube T. Further, in addition to reciprocatingly moving the lance L and spray head C longitudinally through the tube T, the pressurized fluid also acts on the grooved portions of surface 104 on the piston P and causes rotational movement thereof around the longitudinal axis of the tube T, thereby causing the lance L and spray head C to rotate in the tube T. In this manner, the nozzles 106 of the spray head C are continuously directing the cleaning fluid against different portions of the sediment 108, giving rise to a turbulent cleaning action of the cleaning fluid on the sediment 108.

Thus, with the apparatus of the present invention, the pressurized cleaning fluid is used to cause reciprocating movement of the spray head C and lance L longitudinally through the tube T so that sediment 108 along the entire length of tube T is removed. The pressurized fluid is also used to simultaneously cause rotational movement of the spray head C during longitudinal travel through the tube T so that the nozzles 106 are continuously directing the pressurized fluid at new and different portions of the deposited sediment 108 in the tube T to assist in cleaning action. By causing simultaneous reciprocating and rotational movement of the spray head C during cleaning operations in this manner, it has been found that increased cleaning activity of the pressurized water is achieved. The spray head C travels through the tube T along the length thereof, cleaning same, until the piston P engages the inlet head 60, which serves as a stop. When the spray head C has travelled through the length of the tube T and removed sediment therefrom, the valve 75 is again opened. Pressurized fluid enters the supply cylinder S through conduit 64 and exits through conduit 74. The pressurized fluid also acts against surface 102 of the piston P and causes the lance L and spray head C to be retracted from the tube T.

The supply cylinder S, lance L and spray head C are then moved to a new tube T by adjusting the location of supply cylinder S with respect to the frame structure F until the spray head C is mounted in alignment with the longitudinal axis of the next tube to be cleaned. The spray head C is then inserted into such tube and cleaning operations are resumed.

The foregoing disclosure and description of the invention are illustrative and explanatory thereof, and various changes in the size, shape and materials as well as in the details of the illustrated construction may be made without departing from the spirit of the invention.

I claim:

1. A method of cleaning the interior of pipes, tubes and like elongate tubular objects with pressurized fluid, comprising:

(a) directing the fluid from a spray head at an end of a lance against the interior of the object for cleaning same;

(b) transporting the spray head through the object being cleaned;

(c) supplying the fluid to the spray head through the lance;

(d) causing, with the pressurized fluid, reciprocating longitudinal movement of the spray head through the object being cleaned; and (e) causing, with the pressurized fluid, rotational movement of the spray head during longitudinal movement thereof to assist in cleaning the object.

2. The method of claim 1, further including the step of:

controlling the direction of flow of the fluid during said step of supplying.

3. The method of claim 1, further including the step of:

mounting the spray head and lance with the object being cleaned.

4. The method of claim 1, further including the step of:

supporting the spray head and lance adjacent the object being cleaned.

5. The method of claim 1, wherein the object being cleaned has a longitudinal axis and further including the step of:

mounting the spray head and lance in alignment with the longitudinal axis of the object.

6. The method of claim 1, wherein the object has a longitudinal axis, and wherein:

(a) said steps of causing comprise:

(1) causing reciprocating longitudinal movement of the lance and spray head along the axis of the object; and (2) causing rotational movement of the lance and the spray head about the axis of the object.

7. The method of claim 1, wherein the object has a longitudinal axis, and wherein said steps of causing comprise:

(a) causing longitudinal movement of the lance and the spray head along the axis of the object; and (b) simultaneously causing rotational movement of the lance and the spray head about the axis of the object.

* * * * *